US010105718B2

(12) United States Patent
Kim et al.

(10) Patent No.: US 10,105,718 B2
(45) Date of Patent: Oct. 23, 2018

(54) SPRAY ORIFICE STRUCTURE

(71) Applicant: YONWOO CO., LTD., Incheon (KR)

(72) Inventors: Hak-Chan Kim, Incheon (KR); Sang-Hyung Kim, Incheon (KR); Hae-Lyong Jo, Incheon (KR)

(73) Assignee: YONWOO CO., LTD., Incheon (KR)

( * ) Notice: Subject to any disclaimer, the term of this patent is extended or adjusted under 35 U.S.C. 154(b) by 3 days.

(21) Appl. No.: 15/501,723

(22) PCT Filed: Oct. 12, 2015

(86) PCT No.: PCT/KR2015/010714
§ 371 (c)(1),
(2) Date: Feb. 3, 2017

(87) PCT Pub. No.: WO2016/064122
PCT Pub. Date: Apr. 28, 2016

(65) Prior Publication Data

US 2017/0225178 A1 Aug. 10, 2017

(30) Foreign Application Priority Data

Oct. 22, 2014 (KR) ..... 10-2014-0143554

(51) Int. Cl.
*B05B 1/34* (2006.01)
*B05B 1/02* (2006.01)
*B05B 11/00* (2006.01)

(52) U.S. Cl.
CPC ..... *B05B 1/02* (2013.01); *B05B 1/3405* (2013.01); *B05B 1/3436* (2013.01); *B05B 11/00* (2013.01)

(58) Field of Classification Search
CPC ..... B05B 1/02; B05B 1/3436; B05B 1/3405; B05B 11/00
USPC ..... 239/333, 337, 492, 494, 589, 601
See application file for complete search history.

(56) References Cited

U.S. PATENT DOCUMENTS 5,711,488 A * 1/1998 Lund ..... B05B 1/3436 239/333
5,738,282 A * 4/1998 Grogan ..... B05B 1/12 239/333
7,938,342 B2 * 5/2011 Octeau ..... B05B 1/3436 239/333
2004/0046040 A1 3/2004 Micheli
2011/0277686 A1 11/2011 Walter et al.

FOREIGN PATENT DOCUMENTS

JP H11-241808 A 9/1999
KR 2011-0047319 A 5/2011
KR 10-1233080 B1 2/2013

OTHER PUBLICATIONS

International Search Report and Written Opinion issued in PCT/KR2015/010714 dated Feb. 25, 2016.

* cited by examiner

*Primary Examiner* — Steven J Ganey
(74) *Attorney, Agent, or Firm* — Marshall, Gerstein & Borun LLP

(57) ABSTRACT

A spray orifice structure for which, when spraying liquid contents onto a body part, such as a face, hair, an upper body or a lower body, by using a spray type container, it is possible to provide a user with a differentiated spray performance depending on each body part to be sprayed by manufacturing a spray orifice in consideration of an injection angle to which liquid contents are sprayed.

4 Claims, 4 Drawing Sheets

SPRAY ORIFICE STRUCTURE

BACKGROUND

Generally, when a user pushes a spray injection button, spray containers spray liquid contents in a container into a spray state, and are widely used in cosmetics or medicines.

Among these types of spray containers, "Sprayer (Korean Patent Laid-Open Publication No. 2000-0049441)" of the following Patent Document 1 is an ordinary spray device, having an advantage in that by equipping a tube case having a suction hole and a ball for controlling the suction hole, and a double tube suction device composed of an inner case and a tube, it is possible to spray liquid contents even when the spray container is upside down. In addition, the shapes of a second valve and a housing thereof have been improved, such that both parts are always in contact with each other, it is possible to prevent the degradation of spray performance which arises during the spray due to the deformation of the second valve.

However, "Sprayer" of the Patent Document 1 does not indicate a separate structural figures and shapes for a discharging space in a process that liquid contents stored inside a container body are being sprayed through a nozzle by pressurizing a button. Due to this, an injection angel which is the most important among the elements of spray containers is not structured in the best fit for using according to its purpose, such that it is not possible to provide the best spray performance for each body part.

SUMMARY OF THE DISCLOSURE

The present disclosure relates to a spray orifice structure, the spray orifice structure 1 coupled to a discharging part 11 of a spray injection button 10 to spray liquid contents to the outside. The spray orifice structure comprises an outer orifice 100 coupled at the discharging part 11 and forming an outer orifice 100 which has an inner orifice insertion hole 110 such that an inner orifice 200 can be inserted therein, wherein the outer orifice 100 comprises a first injection hole 120 which has a conical shape, formed with a diameter getting smaller from a distal end of the inner orifice insertion hole 110 to a front end side thereof, and a second injection hole 130 which extends from the front end side of the first injection hole 120 and has a predetermined diameter (Φ) and a predetermined length (L), such that an injection angle in which liquid contents are injected is determined by the proportion of the predetermined diameter (Φ) and the predetermined length (L) of the second injection hole 130.

The presently disclosed embodiments are devised to solve the said problems above, and its goal is to provide a spray orifice structure which provides a user with a differentiated spray performance by manufacturing a spray orifice in consideration of an injection angle that liquid contents are sprayed for each body part when spraying liquid type contents onto a body part such as a face, hair, and upper body, lower body or any other part by using a spray container.

To solve the problems in the above, a spray orifice structure according the present disclosure is characterized to comprise an outer orifice 100 coupled at the discharging part 11 and forming an outer orifice 100 which has an inner orifice insertion hole 110 such that an inner orifice 200 can be inserted therein, wherein the outer orifice 100 comprises a first injection hole 120 which has a conical shape, formed with a diameter getting smaller from a distal end of the inner orifice insertion hole 110 to a front end side thereof, and a second injection hole 130 which extends from the front end side of the first injection hole 120 and has a predetermined diameter (Φ) and a predetermined length (L), such that an injection angle in which liquid contents are injected is determined by the proportion of the predetermined diameter (Φ) and the predetermined length (L) of the second injection hole 130.

Furthermore, it is characterized that an injection angle (K) is set to 70° when a diameter of the second injection hole 130 is set to 0.3 mm and a length of a spray orifice is set to 0.6 mm.

Furthermore, it is characterized that an injection angle (K) is set to 40° when a diameter of the second injection hole 130 is set to 0.3 mm and a length of a spray orifice is set to 0.8 mm.

Furthermore, at a circumference of one side of the second injection hole 130 is formed a fillet part 131 having a corner rounded, wherein the fillet part 131 is characterized to have a radius of 0.1 mm rounded.

According to the presently described embodiments, when spraying liquid contents onto a body part, such as a face, hair, an upper body or a lower body, by using a spray type container, it is possible to provide a user with a differentiated spray performance depending on each body part to be sprayed by manufacturing a spray orifice in consideration of an injection angle to which liquid contents are sprayed.

DETAILED DESCRIPTION

Figure 1:
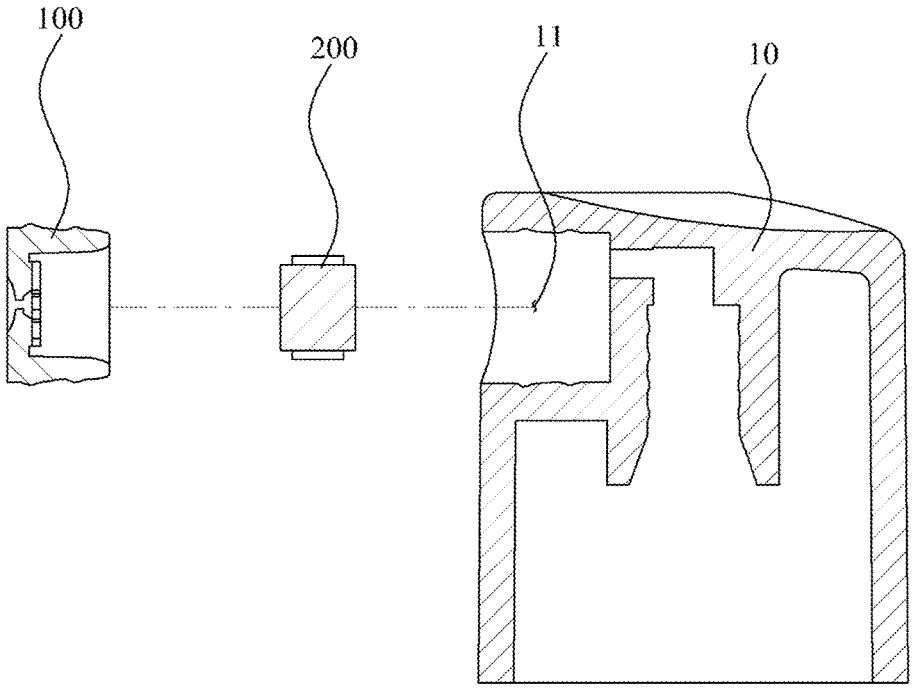
FIG. 1 is an exploded perspective view illustrating a configuration of a spray orifice structure according to an exemplary embodiment.

Hereafter, a spray orifice structure will be described in detail according to exemplary embodiments with reference to the accompanying drawings. First, in the drawings, it is to be noted that the same elements or parts are denoted by the same reference numerals whenever possible. In the description of the present invention, a detailed description of known functions and configurations incorporated herein will be omitted so as not to obscure the subject matter of the present invention.

Figure 4:
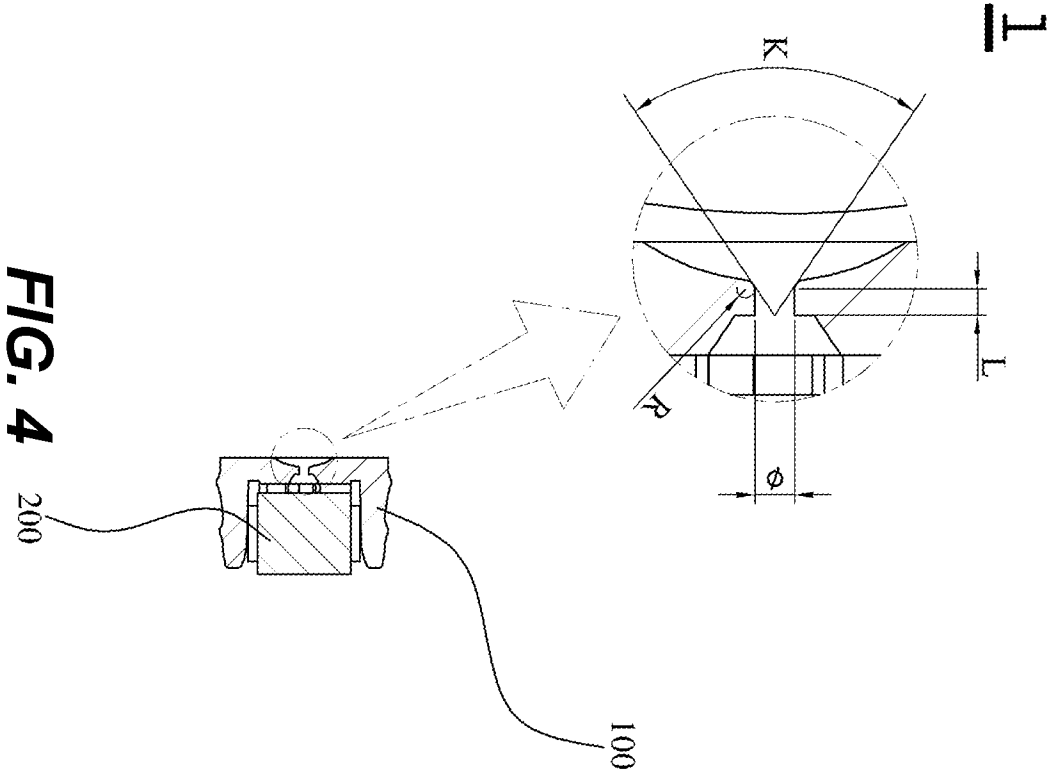

The presently described embodiments, as illustrated in FIG. 4, comprise largely an outer orifice 100 and an inner orifice 200.

Figure 2:
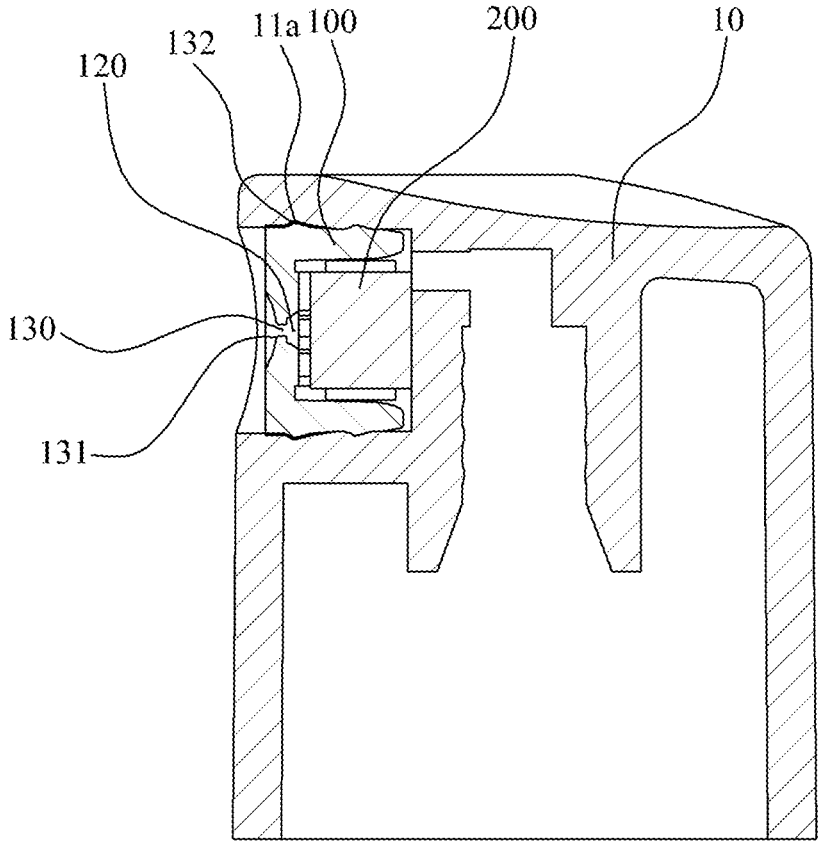
FIG. 2 is a cross sectional view illustrating a configuration of a spray orifice structure according to an exemplary embodiment.

Prior to further explanation, it should be noted that for the sake of clarity, referring to FIG. 2, a left side of the element is referred to as a front end side and a right side is referred to as a distal end side.

Firstly, an outer orifice 100 will be explained. The orifice 100, as illustrated in FIGS. 1 and 2, is an element which is coupled to a discharging part 11 of a spray injection button 10 and sprays liquid contents stored inside a container body (not illustrated) into small particles like mist, further comprising an inner orifice insertion hole 110, a first injection hole 120, and a second injection hole 130.

The inner orifice insertion hole 110, as illustrated in FIG. 1, is an element formed as a space at an inner side of the outer orifice 100, where an inner orifice 200 is inserted.

Figure 3:
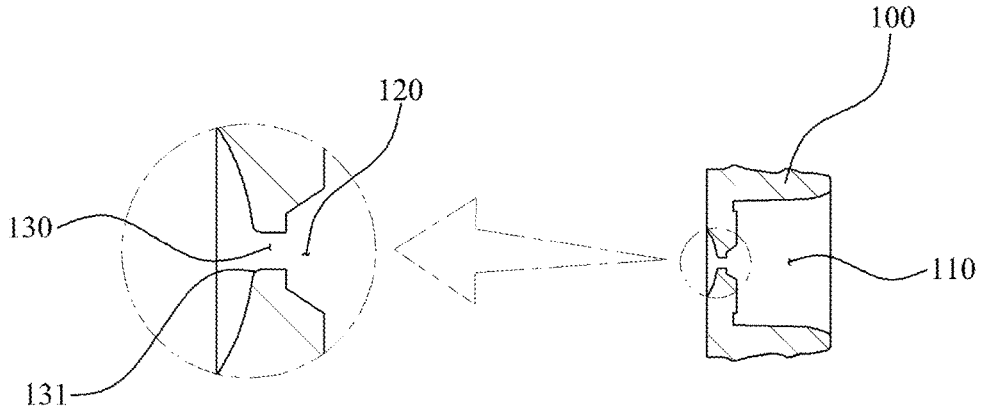
FIGS. 3 and 4 are state diagrams of a second injection hole of an outer orifice among configurations of a spray orifice structure according to an exemplary embodiment.

The first injection hole 120, as illustrated in FIGS. 2 and 3, is a kind of a content movement passage formed with a diameter gradually decreasing to a direction of liquid contents being sprayed at one side of the inner orifice insertion hole 110.

In other words, a front end side is formed to have a smaller diameter than a distal end side.

Due to such a structure, in a process of being moved from a distal end side of the first injection hole 120 to a front end side of the first injection hole 120, liquid contents flowing into a distal end of the first injection hole 120 are compressed as moving more closely toward the first injection hole 120, thereby making the pressure of the front end side of the first injection hole 120 bigger and causing liquid contents to be turned into fine particles as mist.

The second injection hole 130, as illustrated in FIGS. 3 and 4, is a contents spray passage which is formed, perforated to a direction of liquid contents being sprayed at a front end side of the first injection hole 120. The second injection hole 130 is formed with a predetermined diameter (Φ) and a predetermined length (L), such that an injection angle in which liquid contents are sprayed is possible to be determined by a proportion of the diameter (Φ) and the length (L) of the second injection hole 130.

Herefrom, the bigger diameter (Φ) the second injection hole 130 forms, the bigger the cross section area of the second injection hole 130 becomes, such that a sprayed amount of liquid contents passing through the first injection hole 120 increases. The smaller the diameter of the second injection hole 130 gets, the more decreased the cross section of the second injection hole becomes, such that a sprayed amount of liquid contents passing through the first injection hole 120 decreases.

Furthermore, as a length (L) of the second injection hole 130 gets longer, a distance that liquid contents have to move becomes longer, such that an inner pressure of the second injection hole 130 gets reduced in a process that liquid contents pass through the second injection hole 130, and thereby spraying pressure becomes reduced. On the contrary, as a length of the second injection hole 130 is formed shorter, a distance that liquid contents have to move becomes shorter, such that an inner pressure of the second injection hole 130 gets increased in a process that liquid contents pass through the second injection hole 130, and thereby spraying pressure becomes increased.

An injection angle (K) is determined based on the relationship between the diameter (Φ) and the length (L) of the second injection hole 130. When the diameter (Φ) and the length (L) are set to 0.3 mm and 0.6 mm respectively, the injection angle (K) will be determined to 70° whereas the injection angle (K) will be determined to 40° when the diameter (Φ) and the length (L) of the second injection hole 130 are set respectively to 0.3 mm and 0.8 mm.

In this case, to respectively secure an injection angle (K) from the length (L) of the second injection hole 130 formed with a short length, a fillet part 131 with an edge rounded is formed at a circumference of a front end side of the second injection hole 130, wherein the fillet part 131 is preferred to have a rounded edge with a radius of 0.1 mm.

A spray orifice structure 1 with an injection angle (K) of 70° is best fit for applying liquid contents onto a facial surface because the injection angle is wide, whereas a spray orifice structure 1 with an injection angle (K) of 40° is best fit for applying liquid contents onto body parts, arms, or legs because the injection angle (K) is narrow.

Meanwhile, it is preferred that at an outer circumferential surface of the outer orifice 100 are formed one or more coupling protrusions 132 so as to be fixed to the discharging part 11, and that at the discharging part 11 is formed one or more coupling grooves 11*a* so that the coupling protrusions 132 can be coupled therein.

Due to the configuration as the above, the outer orifice 100 can be easily assembled to or detached from the spray injection button 10, such that it is possible to change the outer orifice 100 and the inner orifice 200 with ease and to assemble and examine the outer orifice 100 and the inner orifice 200 individually in a process of manufacturing, thereby leading to lowering defective rate and improving productivity.

Next, an outer orifice 200 will be explained. The inner orifice 200, as illustrated in FIGS. 1 and 2, is inserted to the inner orifice insertion hole 110 and coupled to the outer orifice 100, wherein the inner orifice 200 guides liquid contents moving in a form of water stream from the container body (not illustrated) to be sprayed smoothly.

As described above, option embodiments have been disclosed in the drawings and the specification. Although specific terms have been used herein, these are only intended to describe the present embodiments and are not intended to limit the meanings of the terms or to restrict the scope of the accompanying claims. Therefore, those skilled in the art will appreciate that various modifications and other equivalent embodiments are possible from the above embodiments.

What is claimed is:

1. A spray orifice structure, the spray orifice structure coupled to a discharging part of a spray injection button to spray liquid contents to the outside, comprising an outer orifice coupled at the discharging part and forming an outer orifice which has an inner orifice insertion hole such that an inner orifice can be inserted therein, wherein the outer orifice comprises a first injection hole which has a conical shape, formed with a diameter getting smaller from a distal end of the inner orifice insertion hole to a front end side thereof, and a second injection hole which extends from the front end side of the first injection hole and has a predetermined diameter and a predetermined length, such that an injection angle in which liquid contents are injected is determined by the proportion of the predetermined diameter and the predetermined length of the second injection hole, wherein a fillet part with a rounded edge is formed at a circumference of a front end side of the second injection hole.

2. The spray orifice structure of claim 1, wherein when the predetermined diameter and the predetermined length are set to 0.3 mm and 0.6 mm respectively, the injection angle is to be determined to 70°.

3. The spray orifice structure of claim 1, wherein the injection angle is to be determined to 40° when the predetermined diameter and the predetermined length of the second injection hole are set respectively to 0.3 mm and 0.8 mm.

4. The spray orifice structure of claim 1, wherein the fillet part has a rounded edge with a radius of 0.1 mm.

* * * * *